US005199735A

United States Patent [19]

Tonel

[11] Patent Number: 5,199,735

[45] Date of Patent: Apr. 6, 1993

[54] DEVICE FOR FASTENING FOOTGEAR TO A SPORTS IMPLEMENT

[75] Inventor: Valerio Tonel, Biadene, Italy

[73] Assignee: Nordica S.p.A., Montebelluna, Italy

[21] Appl. No.: 660,089

[22] Filed: Feb. 25, 1991

[30] Foreign Application Priority Data

Mar. 6, 1990 [IT] Italy ..... 82533 A/90

[51] Int. Cl.[5] ..... A63C 9/18

[52] U.S. Cl. ..... 280/615; 280/11.3; 280/11.31; 280/842

[58] Field of Search ..... 280/600, 11.19, 11.3, 280/11.31, 614, 842, 615; 441/70, 75; 36/117, 120, 121

[56] References Cited

U.S. PATENT DOCUMENTS 4,305,603 12/1981 Müller et al. ..... 280/14.2
4,871,337 10/1989 Harris ..... 280/14.2
4,917,400 4/1990 Salomon et al. ..... 280/615

FOREIGN PATENT DOCUMENTS 0095559 12/1983 European Pat. Off. .
0253306 1/1988 European Pat. Off. .
8423057 10/1985 Fed. Rep. of Germany .
2546726 12/1984 France .
2604913 4/1988 France .
2626745 8/1989 France .

*Primary Examiner*—Richard M. Camby
*Attorney, Agent, or Firm*—Guido Modiano; Albert Josif

[57] ABSTRACT

The device for fastening footgear to a sports implement, particularly to a cross-country ski or to a ski mounted on rollers or to a ski for Telemark skiing or to a ski for mountain skiing, has the peculiarity of including at least one means for adjustable elastic contrast to the rotation of the footgear with respect to the sports implement.

6 Claims, 3 Drawing Sheets

DEVICE FOR FASTENING FOOTGEAR TO A SPORTS IMPLEMENT

BACKGROUND OF THE INVENTION

The present invention relates to a device for fastening footgear to a sports implement.

Fastenings associated with skis and suitable for temporarily associating footgear are currently known; in particular, fastenings which allow the rotation of the footgear at an axis which is transverse with respect to the tip in sports which require the rotation of the foot, are known.

Said sports may therefore be cross-country skiing, roller-skiing, Telemark skiing and mountain skiing.

Said known fastenings require rotation contrasting means, such as springs or elastically deformable parts made of plastics, accommodated inside the fastening or in adapted seats.

The disadvantage which can be observed in said known types of fastenings consists of the fact that in practice it is difficult to vary the rotation contrast.

It is in fact unthinkable, due both to operating difficulties and to difficulties in the assembly of the various components, to replace the springs; in those cases in which an adjusting of the springs is indeed provided, said adjusting can be achieved only by using specific tools or by using complicated systems which can increase the weight of the fastening.

The use of elastically deformable and replaceable parts forces the user to have a plurality of spares with different degrees of hardness; this solution is in any case extremely disadvantageous because the skier is forced to keep the parts, for example, in a pocket; the spare parts can thus be lost and will deteriorate in the course of time.

The known fastenings are furthermore not aerodynamically advantageous, and also not aesthetically pleasant.

SUMMARY OF THE INVENTION

The aim of the present invention is therefore to eliminate the disadvantages described above in known types by providing a device which allows to achieve an optimum and structurally simple elastic contrast and to vary, in a rapid and easy manner, the degree of contrast to the rotation of the footgear.

Within the scope of the above described aim, an important object is to provide a structurally simple device as well as easy and straightforward to use.

Another object is to provide a device which associates with the preceding characteristics that of being reliable and safe in use.

Still another important object is to provide a device which associates with the preceding characteristics that of increasing the aerodynamic characteristics of the assembly composed of the footgear and of the device for fastening said footgear to the sports implement.

Not least object is to provide a device which has low manufacturing costs.

The above described aim and objects, as well as others which will become apparent hereinafter, are achieved by a device for fastening footgear to a sports implement which can slide with respect to the ground, comprising means for achieving the oscillation between said footgear and said sports implement, characterized in that it comprises at least one distinct means for elastically contrasting the rotation of said footgear with respect to said sports implement, said at least one distinct means being actuatable by said footgear or by means of at least one interposed element which is associable therewith.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
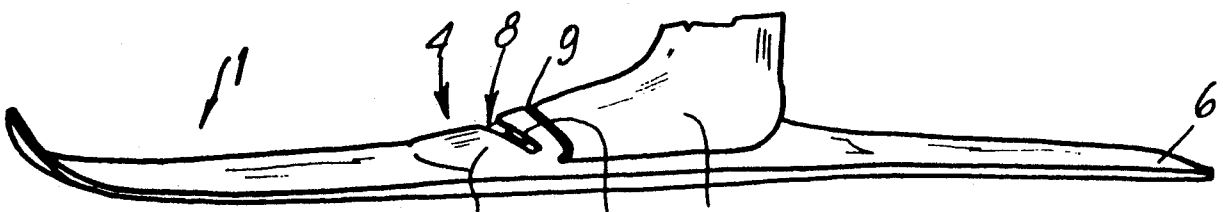
FIG. 1 is a schematic side isometric view of the device applied to a ski.
Figure 2:
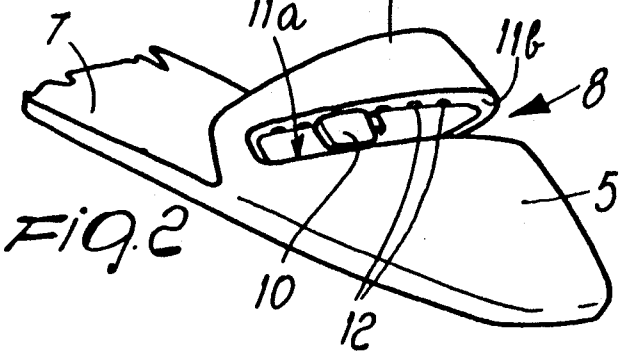
FIG. 2 is a front isometric enlarged view of the device of FIG. 1.
Figure 3:
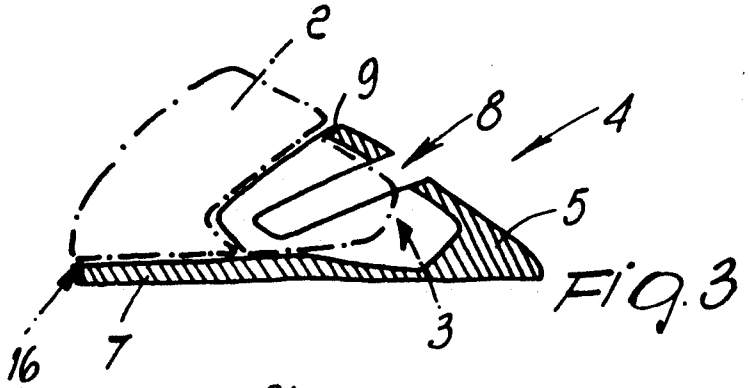
FIG. 3 is a side sectional enlarged view of the device of FIGS. 1 and 2.
Figure 4:
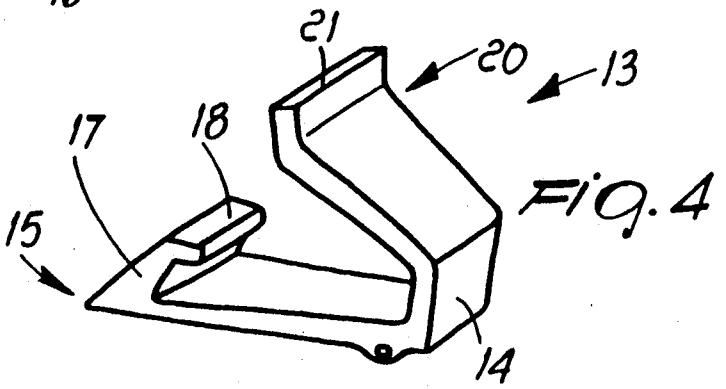
FIG. 4 is a side isometric view of an element for interposition between the footgear and the elastic contrast means of the device.
Figure 5:
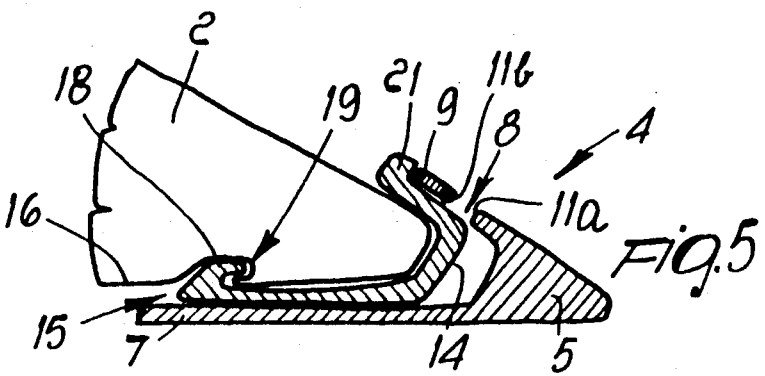
FIG. 5 is a side sectional view, taken along a longitudinal median plane, of the interposition element associated with the elastic contrast means and with footgear.

With reference to the above figures, in the particular embodiment, the reference numeral 1 indicates a ski for cross-country skiing, for mountain skiing or for Telemark skiing, to which a fastening device, not illustrated, is thus applied, said device being suitable for temporarily coupling the footgear 2 of the user at the tip 3 so as to allow its rotation during the practice of sports.

The fastening device comprises at least one means, generally indicated by the reference numeral 4, for elastically contrasting the rotation of the footgear 2 with respect to the ski 1.

Said means is constituted by a tip element 5 which embraces both the device for fastening the footgear to the ski and partially the tip 3 of the footgear.

Said tip element 5 can advantageously have, in the direction of the rear end 6 of the ski 1, a wing 7 for supporting the sole of the footgear 2, the width of said wing being approximately equal to that of said ski.

The tip element 5 furthermore has, along an axis which is transverse thereto, a slot 8, thus defining a band-like element which has a transverse perimetric edge, the band-like element being elastically connected at its ends to the tip element 5.

At least one slider 10 can be advantageously interposed at said slot 8.

Said slider is slidably associated, at the slot 8, so as to vary the contract offered during the forward flexing of the footgear, said flexing imposing a deformation to the tip element 5 and varying the interspace between the facing edges 11*a* and 11*b* of the slot 8. edges 11*a* and 11*b* of the slot 8.

Said slider 10 can thus have adapted pairs of tabs which slidably engage said edges 11*a* and 11*b*.

As an alternative, the slider 10 can have adapted projections which protrude from one of its sides and are selectively engageable at adapted holes 12 defined for example at the edge 11*b*.

It is furthermore advantageously possible to provide an element 13 for interposition between the footgear 2 and the means 4; said element 13 is constituted by a V-shaped monolithic part made of plastics which has an appropriately squared vertex 14 which can be arranged inside the tip element 5.

Means for engaging the sole 16 of the footgear 2 are provided at a first wing 15 which is arranged in contact with the wing 7 of the tip element 5 and is possibly articulated thereto; said means are constituted by an essentially L-shaped transverse lug 17, an end 18 whereof, directed toward the vertex 14, engages a complementarily shaped seat 19 defined on the sole 16 of the footgear 2.

A projection 21 is instead provided at the second wing 20 of the element 13 and abuttingly interacts with the transverse perimetric edge 9 of the tip element 5.

The device, according to the invention, therefore allows, by varying the position of the slider 10, to vary the elastic contrast of the tip element 5 to the rotation of the footgear 2 with respect to the ski 1.

It has thus been observed that the invention has achieved the intended aim and objects, and that it is possible to achieve in a simple manner an elastic contrast as well as a variation of the degree of rotation contrast, said variation being obtainable in a rapid and easy manner on the part of the skier.

The means 4 is furthermore structurally very simple and can act as fairing for the device for fastening the footgear to the sports implement, thus considerably increasing the aerodynamic characteristics thereof.

The means 4 may naturally be constituted by an element which is applied on the surface of the sports implement, said element being obtained by thermoforming or being screwed, glued or welded to the sports implement.

The means 4 can furthermore optionally be interposed between the region in which the fastening device is fixed to the sports implement, and an oscillating component which is articulated to said fastening device.

If the interposition element 13 is used, said element acts directly on the transverse perimetric edge 9 of the tip element 5.

The invention is naturally susceptible to numerous modifications and variations, all of which are within the scope of the same inventive concept.

The transverse perimetric edge 9, for example, can be a separate element applied on the tip element 5.

Likewise, the number and configuration and arrangement of the slots at the tip element may be any according to the specific requirements.

Figure 6:
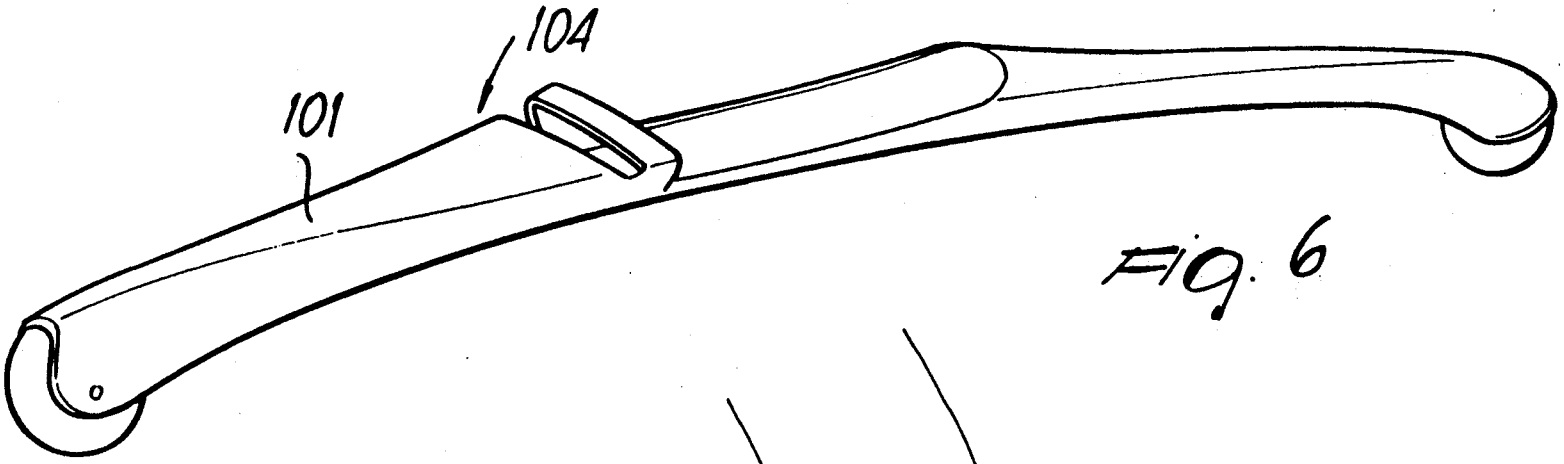
FIGS. 6 and 7 are side isometric views of the device applied to a roller-ski, showing respectively the roller-ski alone and the roller-ski engaged by an item of footgear.
Figure 7:
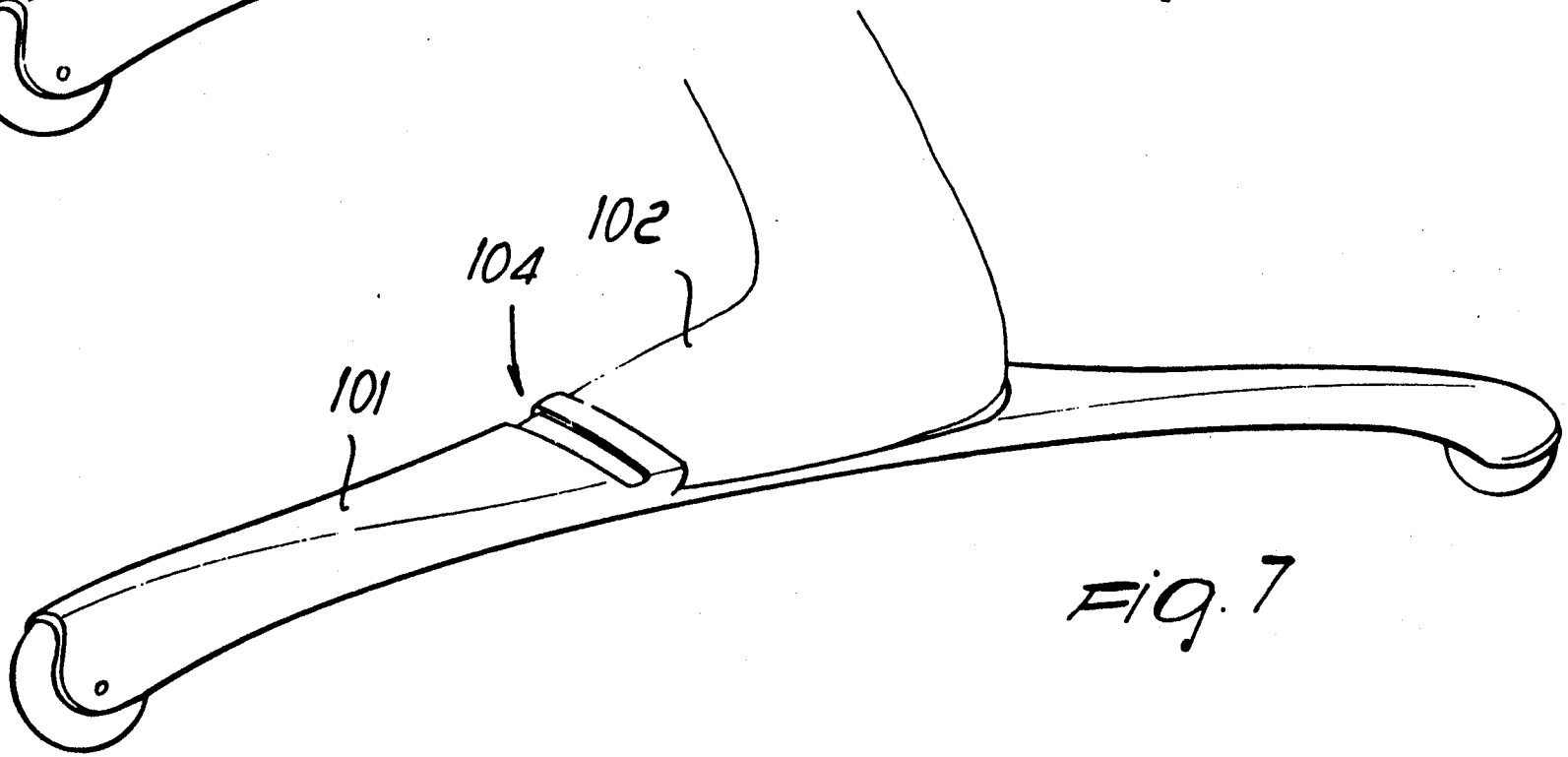
Figure 8:
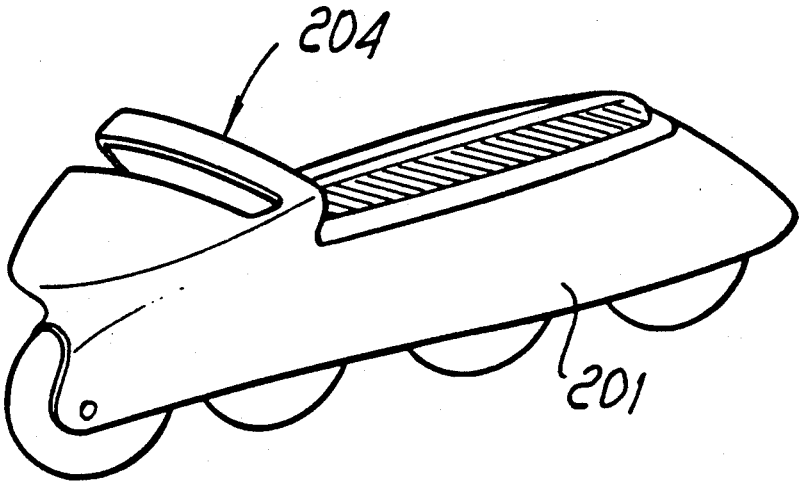
FIGS. 8 and 9 are side isometric views of the device applied to a roller-skate, showing respectively the roller-skate alone and the roller-skate engaged by an item of footgear.
Figure 9:
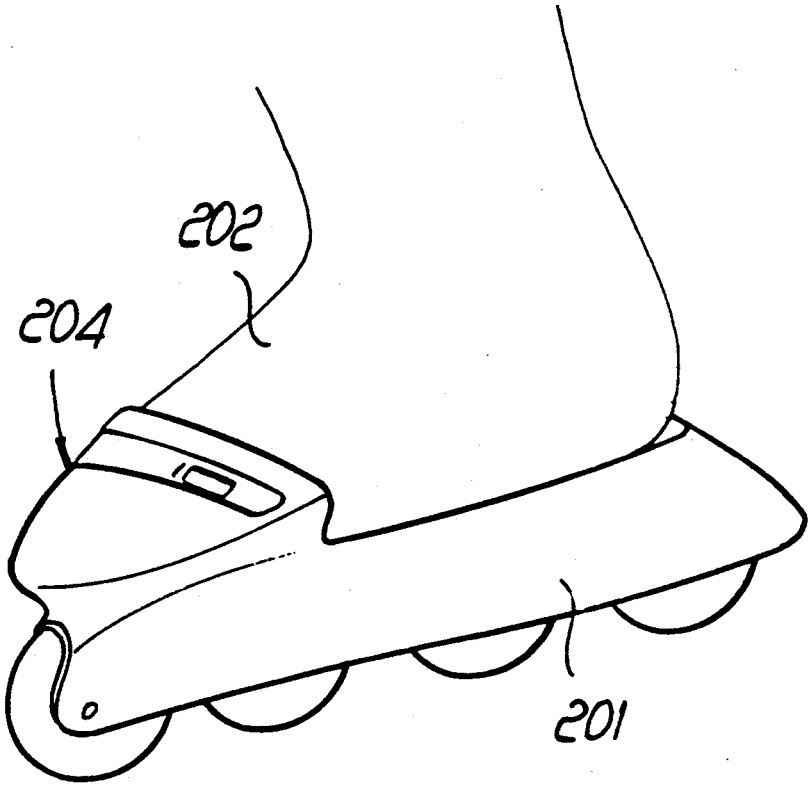

FIGS. 6, 7 show a device 104, according to the invention, applied to a roller-ski 101 and adapted to engage an item of footgear 102 as above described. the invention, applied to a roller-skate 201 and adapted to engage an item of footgear 202 as above described.

The materials and dimensions which constitute the individual components of the device may also naturally be the most pertinent according to the specific requirements.

I claim:

1. A device for fastening an item of footgear to a sports implement which can slide with respect to the ground, comprising:

a tip element which is connectable to the sports implement and which has at least one seat for accommodating at least a tip region of the item of footgear;

a band-like element having ends which are elastically connected to said tip element;

at least one transverse slot defined between said tip element and said band-like element, thereby said band-like element being elastically deformable with respect to said tip element for allowing an oscillation to the item of footgear with respect to the sports implement; and at least one member for controlling the elastic deformation of said band-like element with respect to said tip element, said at least one member being positionally accommodated in said at least one slot.

2. The device according to claim 1, wherein said at least one member is a slider which is slidably accommodated in said slot.

3. The device according to claim 1, wherein said at least one member is a slider which is slidably accommodated in said slot, said slot having a pair of mutually facing edges in which are provided a plurality of holes, said slider having tab elements for lockingly engaging in said holes of said facing edges of said slot.

4. The device according to claim 1, wherein said tip element is provided with a rearwardly extending wing element for supporting a sole of the item of footgear, said wing element having a width equal to a transverse extension of the sports implement.

5. The device according to claim 1, further comprising an interposition element arranged between said tip element and said tip region of the item of footgear.

6. The device according to claim 1, further comprising an interposition element arranged between said tip element and said tip region of the item of footgear, said interposition element comprising a monolithic V-shaped piece, a rearwardly extending first wing provided with an L-shaped lug engagable with a seat provided in a sole of the item of footgear, an upwardly extending second wing provided with a projection for engaging with an upper perimetric edge of said band-like element.

* * * * *